US009416658B2

(12) United States Patent
Melat et al.

(10) Patent No.: US 9,416,658 B2
(45) Date of Patent: Aug. 16, 2016

(54) FLUID TANK BALANCING SYSTEM FOR MINING MACHINE

(71) Applicant: Joy MM Delaware, Inc., Wilmington, DE (US)

(72) Inventors: Kyle Melat, Cranberry, PA (US); Jeff Ley, Cranberry, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 21 days.

(21) Appl. No.: 14/601,731

(22) Filed: Jan. 21, 2015

(65) Prior Publication Data

US 2015/0204191 A1 Jul. 23, 2015

Related U.S. Application Data

(60) Provisional application No. 61/929,749, filed on Jan. 21, 2014.

(51) Int. Cl.
*E21F 5/02* (2006.01)
*E21C 27/32* (2006.01)

(52) U.S. Cl.
CPC .. *E21C 27/32* (2013.01); *E21F 5/02* (2013.01)

(58) Field of Classification Search
CPC ..... E21F 5/02
See application file for complete search history.

(56) References Cited

U.S. PATENT DOCUMENTS 3,170,732 A 2/1965 Hlinsky
3,556,682 A 1/1971 Sakamoto et al.
3,776,592 A 12/1973 Ewing
3,825,091 A 7/1974 Geselbracht et al.
3,861,749 A * 1/1975 Georg ..... E21C 37/18 299/14
4,290,648 A 9/1981 Takahashi et al.
4,531,782 A 7/1985 Ford et al.
4,542,940 A 9/1985 Marten
4,634,186 A 1/1987 Pease
4,934,757 A 6/1990 Steinkuhl et al.
4,968,098 A 11/1990 Hirsch et al.

(Continued)

FOREIGN PATENT DOCUMENTS

DE 3800539 7/1989
GB 1518542 A * 7/1978 ..... E21F 17/06
WO 2011157094 12/2011

OTHER PUBLICATIONS

International Search Report and Written Opinion for PCT Application No. PCT/US2015/012210 dated Apr. 28, 2015 (11 pages).

*Primary Examiner* — John Kreck
(74) *Attorney, Agent, or Firm* — Michael Best & Friedrich LLP

(57) ABSTRACT

A mining machine includes a frame, a first fluid tank, a second fluid tank, a valve, and a control system. The first fluid tank is supported on the frame proximate a first end, and the second fluid tank is supported on the frame proximate a second end. The valve permits fluid communication between the first and second fluid tanks when the valve is in a first position, and prevents fluid communication between the first and second fluid tanks when the valve is in a second position. The control system includes a first sensor detecting an amount of fluid in the first tank, a second sensor detecting an amount of fluid in the second tank, and a controller. The controller moves the valve to the first position when the difference between the amounts of fluid in the first and second tanks a predetermined threshold.

18 Claims, 4 Drawing Sheets

(56) References Cited

U.S. PATENT DOCUMENTS

| | | | | |
|---|---|---|---|---|
| 4,976,495 | A | 12/1990 | Lewins et al. | |
| 5,161,857 | A | 11/1992 | Mayercheck et al. | |
| 5,181,934 | A | 1/1993 | Stolarczyk | |
| 5,518,299 | A * | 5/1996 | Adamczyk | E21F 5/20 299/12 |
| 5,960,809 | A * | 10/1999 | Keller | F02M 37/0023 137/100 |
| 5,964,078 | A | 10/1999 | Robinson | |
| 6,007,157 | A | 12/1999 | Stewart | |
| 6,386,640 | B1 | 5/2002 | Neilson | |
| 6,467,201 | B1 | 10/2002 | McSharry | |
| 6,494,226 | B2 * | 12/2002 | Tipton | B60K 15/00 123/514 |
| 7,475,947 | B2 | 1/2009 | LeBegue | |
| 7,695,071 | B2 | 4/2010 | Jackson et al. | |
| 2011/0006584 | A1 | 1/2011 | Junker et al. | |
| 2011/0209789 | A1 | 9/2011 | Murabayashi | |
| 2011/0254345 | A1 | 10/2011 | Neilson et al. | |
| 2011/0254346 | A1 | 10/2011 | Neilson et al. | |
| 2012/0139225 | A1 | 6/2012 | Sonderegger | |
| 2012/0161493 | A1 | 6/2012 | Junker et al. | |
| 2012/0205964 | A1 | 8/2012 | In't Hout et al. | |
| 2012/0324878 | A1 | 12/2012 | Batenburg | |
| 2013/0033085 | A1 | 2/2013 | Wade et al. | |
| 2013/0219877 | A1 | 8/2013 | Hughes | |

* cited by examiner

FLUID TANK BALANCING SYSTEM FOR MINING MACHINE

CROSS-REFERENCE TO RELATED APPLICATIONS

This application claims the benefit of prior-filed, co-pending U.S. Provisional Application Ser. No. 61/929,749, filed Jan. 21, 2014, the entire contents of which is hereby incorporated by reference.

BACKGROUND

The present invention relates to the field of mining machines. Specifically, the present invention relates to a fluid balancing system for a mobile mining machine.

Conventional longwall shearers include a frame and a pair of cutting assemblies mounted on each end of the frame. Each cutting assembly includes a cutting drum for engaging a mine wall. As the frame traverses a mine frame, the cutting drums cut material from the mine face. In some embodiments, the material is deposited on a conveyor and carried away from the mine face. The floor of the mine may be uneven, and therefore it is possible for the frame to be inclined or positioned on a slope as it travels back and forth relative to the mine face.

SUMMARY

In one aspect, the mining machine includes a frame, a first fluid tank, a second fluid tank, a valve, and a control system. The frame includes a first end and a second end and at least one cutting assembly. The first fluid tank is supported on the frame proximate the first end. The second fluid tank is supported on the frame proximate the second end. The valve is movable between a first position and a second position. The valve permits fluid communication between the first fluid tank and the second fluid tank when the valve is in the first position. The valve prevents fluid communication between the first fluid tank and the second fluid tank when the valve is in the second position. The control system includes a first sensor, a second sensor, and a controller. The first sensor detects an amount of fluid in the first fluid tank, and the second sensor detects an amount of fluid in the second fluid tank. The controller moves the valve to the first position when the difference between the amount of fluid in the first fluid tank and the amount of fluid in the second fluid tank exceeds a predetermined threshold.

In another embodiment, a fluid balancing system balances the amount of fluid in at least two fluid tanks supported on a mobile mining machine. The fluid balancing system includes a valve, a first sensor, a second sensor, and a controller. The valve is movable between a first position and a second position. The valve is configured to permit fluid communication between the fluid tanks when the valve is in the first position, and the valve configured to prevent fluid communication between the fluid tanks when the valve is in the second position. The first sensor is configured to generate a first signal indicative of an amount of fluid in a first fluid tank. The second sensor is configured to generate a second signal indicative of an amount of fluid in a second fluid tank. The controller compares the first signal and the second signal and calculates a difference between the amount of fluid in the first tank and the amount of fluid in the second tank. The controller moves the valve to the first position when the difference exceeds a predetermined threshold.

In yet another embodiment, a method of balancing fluid levels between a first tank and a second tank supported on a mobile mining machine includes: providing a valve movable between a first position and a second position such that the valve permits fluid communication between the first tank and the second tank when the valve is in the first position, and the valve prevents fluid communication between the first tank and the second tank when the valve is in the second position; generating a first signal indicative of an amount of fluid contained in the first tank; generating a second signal indicative of an amount of fluid contained in the second tank; comparing the first signal and the second signal to calculate a difference between the amount of fluid in the first tank and the amount of fluid in the second tank; comparing the calculated difference against a predetermined threshold; and when the calculated difference exceeds the predetermined threshold, moving the valve to the first position to permit fluid communication between the first tank and the second tank.

Other aspects of the invention will become apparent by consideration of the detailed description and accompanying drawings.

DETAILED DESCRIPTION

Before any embodiments of the invention are explained in detail, it is to be understood that the invention is not limited in its application to the details of the configuration and arrangement of components set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Figure 1:
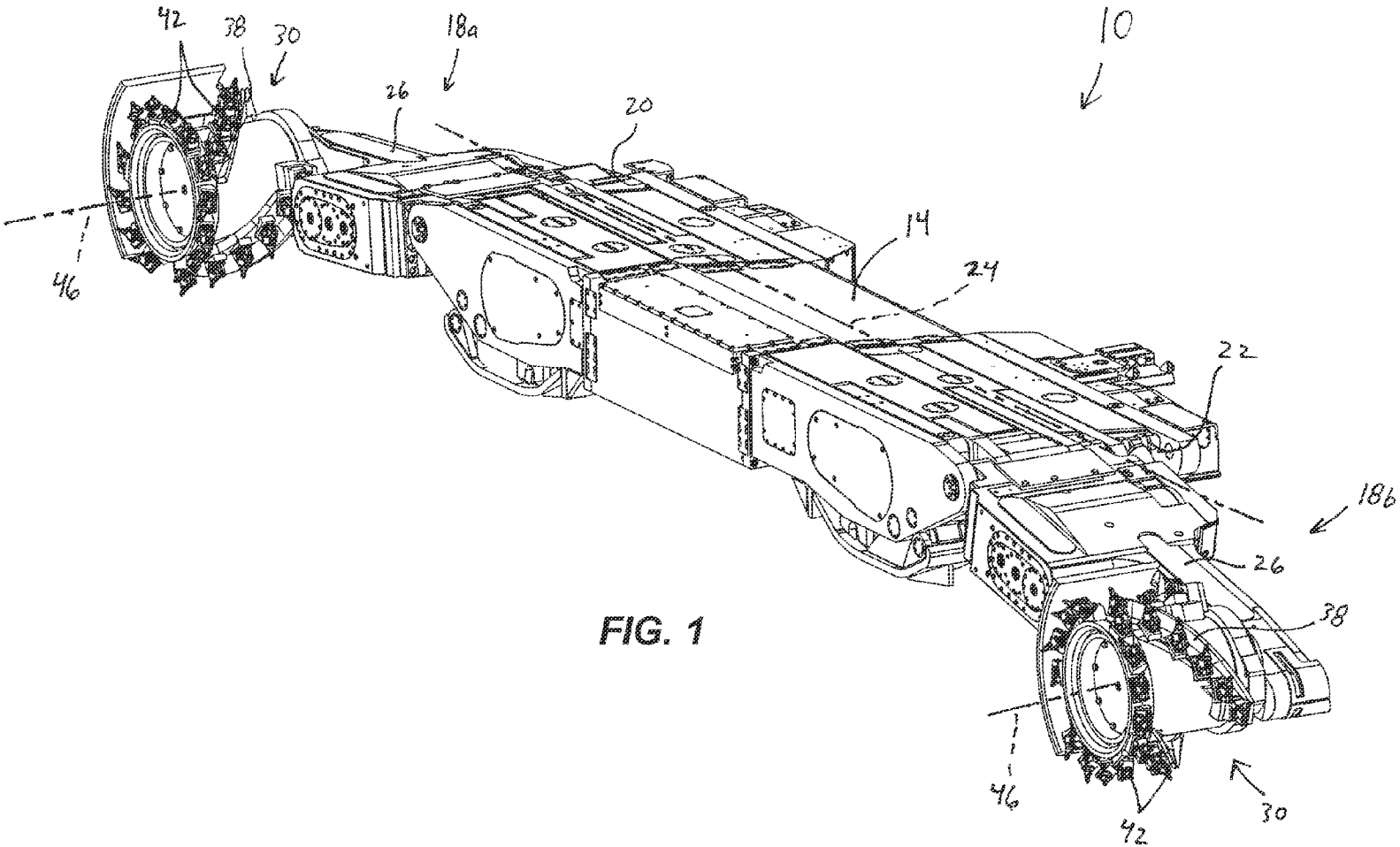
FIG. 1 is a perspective view of a mining machine.

FIG. 1 illustrates a mining machine, such as a longwall shearer 10, including a chassis or frame 14 and a pair of cutting assemblies 18. The frame 14 includes a first end 20, a second end 22, and a body axis 24 extending between the first end 20 and the second end 22. A first cutting assembly 18*a* is coupled to the first end 20 of the frame 14 and a second cutting assembly 18*b* is coupled to the second end 22.

Each cutting assembly 18 includes a ranging arm 26 and a cutting drum 30. The ranging arm 26 is pivotably coupled to the frame 14 and rotatably supports the cutting drum 30. Each drum 30 is coupled to an end of a ranging arm 26 and is rotatable about a drum axis 46 that is generally perpendicular to the ranging arm 26. The cutting drum 30 includes a generally cylindrical body having vanes 38 and cutting bits 42 positioned along the front end of the drum 30 and along the edges of the vanes 38. In the illustrated embodiment, the vanes 38 extend in a spiral or helical manner along the periphery of the drum body. In some embodiments, the cutting assembly 18 may also include a guide for deflecting cut material toward a material handling mechanism, e.g., a face conveyor 48 (FIG. 3).

Figure 2:
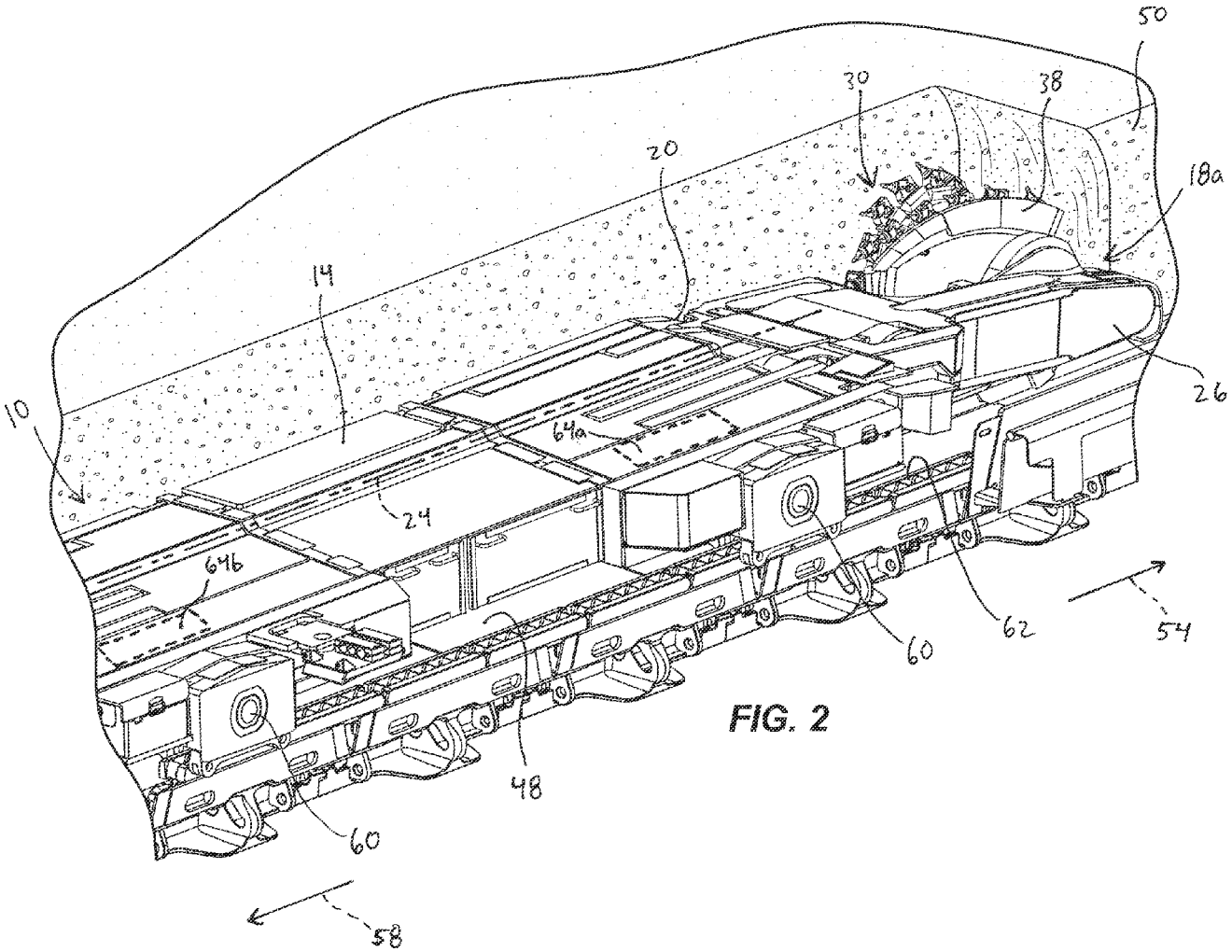
FIG. 2 is a rear perspective view of a portion of the mining machine of FIG. 1 and a mine face.
Figure 3:
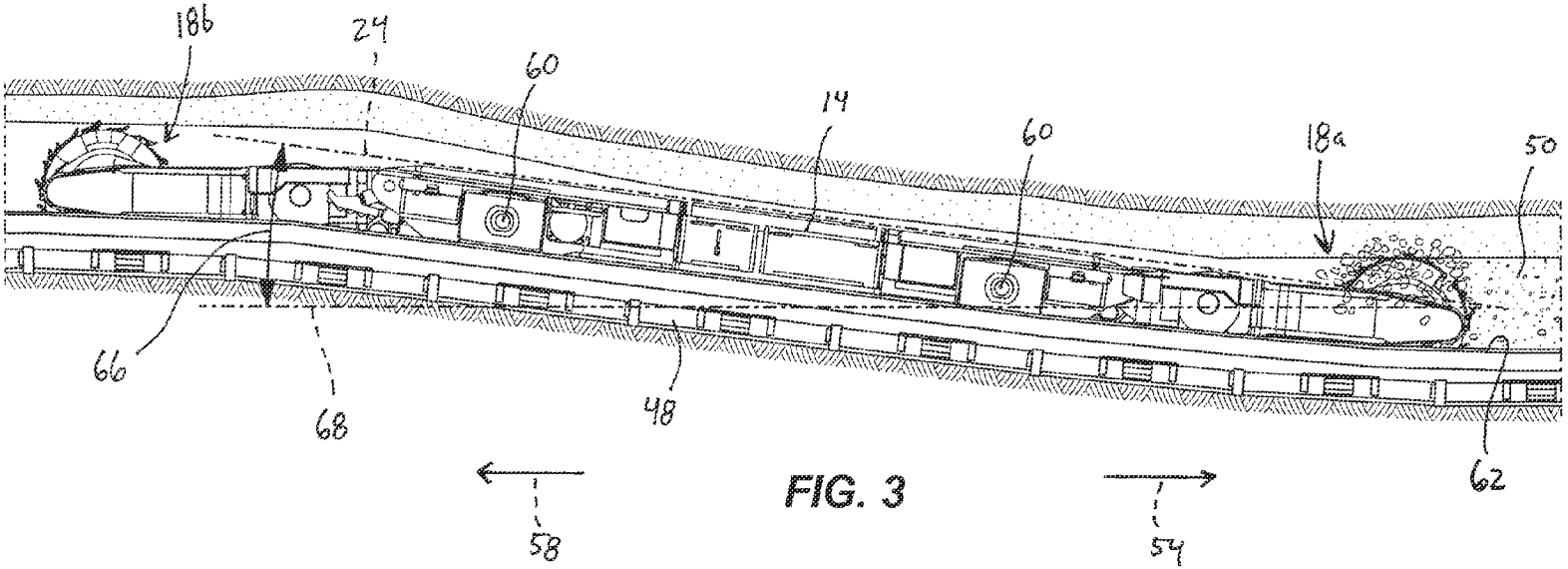
FIG. 3 is a rear end view of the mining machine of FIG. 1 and a mine face.

As shown in FIGS. 2 and 3, the frame 14 is configured to tram or move along a wall of material to be mined or mine face 50 in a first direction 54 and a second direction 58. In the illustrated embodiment, the frame 14 includes a drive sprocket assembly 60 that engages a rack 62 to form a rack-and-pinion connection. The rack 62 is coupled to the face conveyor 48 and advances toward the mine face 50 as the frame 14 completes a predetermined number of passes along the face 50. The rotation of the drive sprocket assembly 60 drives the frame 14 along the rack 62.

Referring to FIG. 2, each drum 30 is configured to engage the mine face 50 such that the bits 42 cut material from the face 50. As the cutting drum 30 rotates, the vanes 38 carry the cut material from the face 50 toward a rear end of the drum 30, where the cut material is deposited onto the face conveyor 48 below the frame 14. As the frame 14 moves in the first direction 54, the first cutting assembly 18*a* is in a leading position and the second cutting assembly 18*b* (FIG. 3) is in a trailing position. In one embodiment, the first cutting assembly 18*a* is elevated to cut material, such as coal, from an upper portion of the mine face 50, while the second cutting assembly 18*b* is in a lower position to cut material from a lower portion of the mine face 50.

In one embodiment, each cutting assembly 18 is hydraulically driven and the frame 14 supports a pair of fluid tanks 64 (FIG. 2) for providing pressurized fluid to drive the cutting assemblies 18. In the illustrated embodiment, a first fluid tank 64*a* is positioned proximate the first end 20 of the frame 14 and a second fluid tank 64*b* is positioned proximate the second end 22 of the frame 14. In some mines, the mine face 50 is inclined laterally. As a result, as the frame 14 moves from one side of the mine face 50 to the other, the frame 14 may be oriented on an incline such that the body axis 24 of the frame 14 forms a lateral angle 66 relative to a horizontal plane 68 during at least a portion of the movement.

Figure 4:
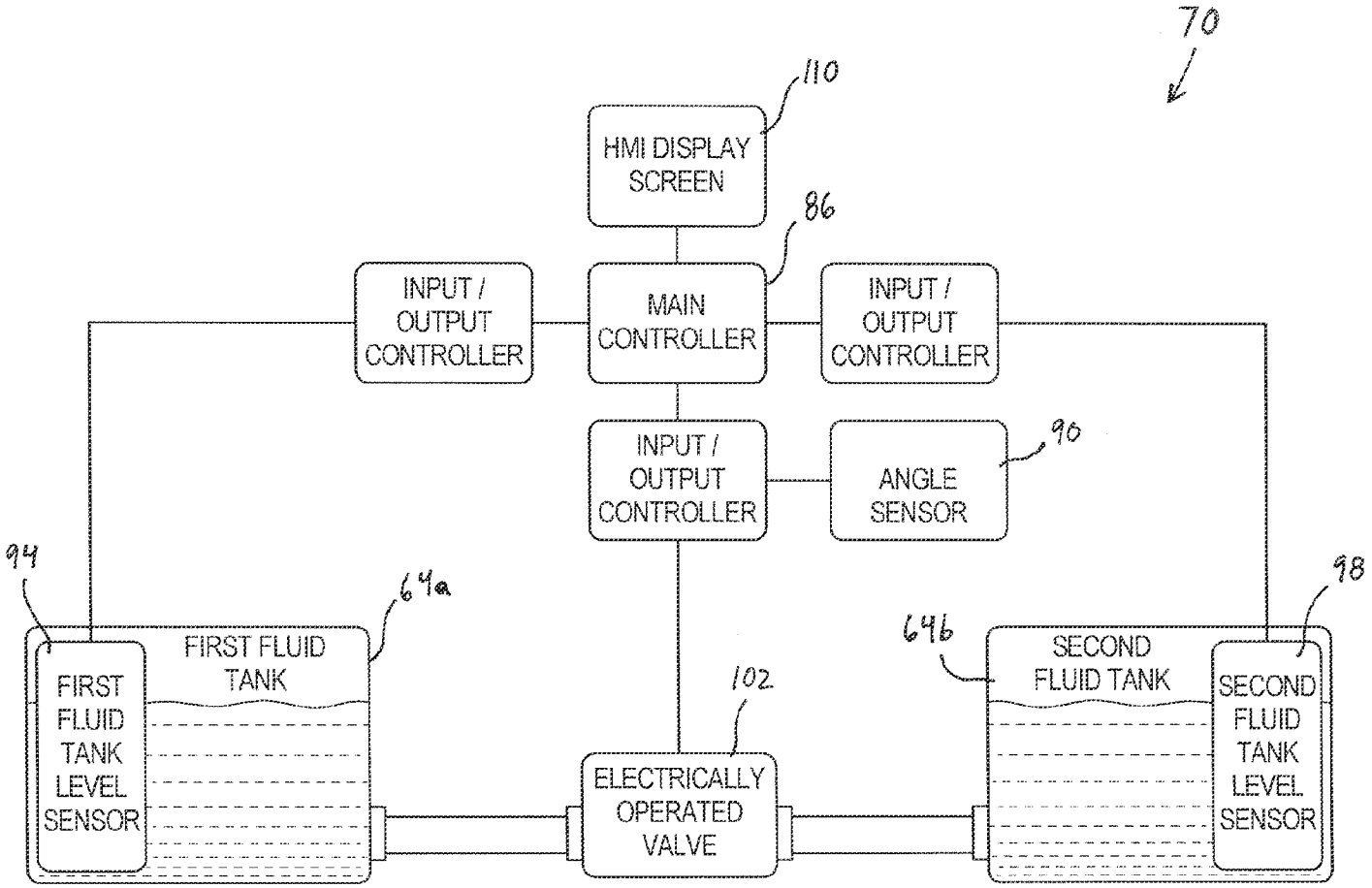
FIG. 4 is a schematic view of a fluid balancing system.

FIG. 4 illustrates a control system 70 for balancing fluid levels between the first tank 64*a* and the second tank 64*b*. The system 70 includes a main controller 86, a frame angle sensor 90, a first sensor 94, a second sensor 98, and a valve 102 in fluid communication with the first tank 64*a* and the second tank 64*b*. In the illustrated embodiment, the valve 102 is an electrically-operated valve (e.g., a solenoid valve). In other embodiments, other types of valves may be used.

The frame angle sensor 90 detects the roll angle of the frame 14, or the angle 66 (FIG. 3) of the body axis 24 of the frame 14 relative to the level plane 68 (FIG. 3). The frame angle sensor 90 generates a signal representing the measured frame angle 66 and transmits the signal to the main controller 86. The first sensor 94 detects an amount of fluid in the first tank 64*a*, and the second sensor 98 detects an amount of fluid in the second tank 64*b*. In one embodiment, the sensors 94, 98 are analog fluid level sensors. The sensors 94, 98 may measure the height of fluid contained in each fluid tank 64*a*, 64*b*. Each sensor 94, 98 generates a signal representing the detected amount of fluid in their respective tanks 64*a*, 64*b* and transmits the signal to the main controller 86. In some embodiments, each signal from the sensors 94, 98 represents a ratio or percentage of the respective tank 64*a*, 64*b* that filled with fluid. The main controller 86 compares the signals generated by each sensor 94, 98.

In one embodiment, when the sensed amount of fluid in either tank 64*a*, 64*b* is below a predetermined level, the main controller 86 generates an alarm and disables a fluid pump (not shown) operating the cutting assembly 18*a*, 18*b* associated with the tank 64*a*, 64*b* that is low. In some embodiments, the predetermined level is defined or set by a user depending on a variety of factors. The controller 86 confirms that the angle 66 detected by the frame angle sensor 90 is within an acceptable range and, if so, a human-machine interface (HMI) display screen 110 (FIG. 4) prompts a machine operator to initiate a "Tank Level Balance" function. If the frame angle 66 is not within a permitted range, the main controller 86 does not permit the valve 102 to be opened. In one embodiment, the permitted range for the frame angle 66 is less than or equal to 20 degrees relative to a horizontal plane. Due to various factors, the permitted range of the frame angle 66 may not be symmetric relative to the horizontal plane; that is, the negative limit may be different from the positive limit of the permitted range. In some embodiments, the main controller 86 includes a comparator comparing the difference between the amount of fluid in each fluid tank 64, and the main controller 86 generates an alarm if the difference exceeds a predetermined threshold. In some embodiments, the main controller 86 automatically actuates the valve 102 when the difference exceeds the predetermined threshold and the frame angle 66 is within the permitted range.

If the angle 66 detected by the frame angle sensor 90 is within an acceptable range, the main controller 86 moves the valve 102 to an open position to permit fluid flow between the tanks 64*a*, 64*b*. The valve 102 remains open until the fluid levels detected by each sensor 94, 98 are substantially equal to one another (i.e., the difference between the fluid level of the first tank 64*a* and the fluid level of the second tank 64*b* is less than a predetermined amount). When this condition is satisfied, the main controller 86 de-energizes the valve 102, moving it to a closed position to prevent flow between the tanks 64*a*, 64*b*.

During a mining operation, fluid may be depleted in one of the tanks 64*a*, 64*b* while the machine 10 is located in a position that is difficult to access and away from a fluid supply (e.g., the far extreme of the mine face 50). On a conventional mining machine, this requires an operator to carry containers of fluid to the machine and refill the tank that is depleted, which is time-consuming and cumbersome. The control system 70 permits fluid to flow from one tank to the other in the event that the fluid in a single tank has become low, thereby transferring fluid from a full (or partially full) tank to a depleted or low tank without requiring a machine operator to manually fill the low tank to a desired level.

Balancing the tanks 64 allows the machine 10 to continue operation at least until the machine 10 is positioned in an area of the mine that facilitates servicing the machine 10 (e.g., close to a supply of fluid for re-filling the tanks 64). In addition, in a maintenance situation when one or both tanks 64 are low on fluid, an operator can fill one of the tanks 64 and utilize the fluid level balancing sequence to transfer the fluid to the other tank. By only filling one of the tanks 64, the operator reduces maintenance time and reduces the possibility that debris in the mine environment and around a tank port (not shown) will enter the port and contaminate the fluid. Furthermore, by sensing the lateral angle 66 of the machine frame 14, the control system 70 prevents the valve 102 from being opened when the machine 10 is positioned on an incline (FIG. 3) that would inhibit fluid flow between the tanks 64 or that would make it difficult to fill the tanks 64 equally.

Thus, the invention provides, among other things, a fluid tank balancing system for a mobile mining machine. Although the invention has been described in detail with reference to certain preferred embodiments, variations and modifications exist within the scope and spirit of one or more independent aspects of the invention as described.

We claim:

1. A mining machine comprising:

a frame including a first end and a second end and at least one cutting assembly;

a first fluid tank supported on the frame proximate the first end;

a second fluid tank supported on the frame proximate the second end;

a valve movable between a first position and a second position, the valve permitting fluid communication between the first fluid tank and the second fluid tank when the valve is in the first position, the valve preventing fluid communication between the first fluid tank and the second fluid tank when the valve is in the second position; and a control system including a first sensor, a second sensor, and a controller, the first sensor detecting an amount of fluid in the first fluid tank, the second sensor detecting an amount of fluid in the second fluid tank, the controller moving the valve to the first position when the difference between the amount of fluid in the first fluid tank and the amount of fluid in the second fluid tank exceeds a predetermined threshold.

2. The mining machine of claim 1, wherein the first sensor detects a fluid level in the first fluid tank, and the second sensor detects a fluid level in the second fluid tank.

3. The mining machine of claim 1, wherein the frame defines a frame axis extending between the first end and the second end, and wherein the control system further comprises a frame angle sensor detecting a frame angle defined between the frame axis and a level plane.

4. The mining machine of claim 3, wherein the controller moves the valve to a first position only if the detected frame angle is within a predetermined range.

5. The mining machine of claim 4, wherein the predetermined range is between zero degrees and twenty degrees with respect to a level plane.

6. The mining machine of claim 1, wherein the frame further includes a first cutting assembly coupled to the first end and a second cutting assembly coupled to the second end, the frame moving in a direction that is substantially parallel to a mine face.

7. The mining machine of claim 1, wherein the frame includes a drive sprocket engaging a rack, wherein rotation of the sprocket moves the frame along the rack.

8. The mining machine of claim 1, wherein, when the difference between the amount of fluid in the first tank and the amount of fluid in the second tank exceeds a predetermined threshold, the controller generates an alarm for a user such that a user must permit the controller to move the valve before the controller moves the valve to the first position.

9. A fluid balancing system for balancing the amount of fluid in at least two fluid tanks supported on a longwall mining machine, the fluid balancing system comprising:

a valve movable between a first position and a second position, the valve configured to permit fluid communication between the fluid tanks when the valve is in the first position, the valve configured to prevent fluid communication between the fluid tanks when the valve is in the second position;

a first sensor configured to generate a first signal indicative of an amount of fluid in a first fluid tank;

a second sensor configured to generate a second signal indicative of an amount of fluid in a second fluid tank;

a controller comparing the first signal and the second signal and calculating a difference between the amount of fluid in the first tank and the amount of fluid in the second tank, the controller moving the valve to the first position when the difference exceeds a predetermined threshold.

10. The fluid balancing system of claim 9, wherein the first sensor is a fluid level sensor and the second sensor is a fluid level sensor.

11. The fluid balancing system of claim 9, further comprising a frame angle sensor configured to generate a signal indicative of a roll angle of the longwall mining machine frame with respect to a horizontal plane.

12. The fluid balancing system of claim 11, wherein the controller moves the valve to a first position only if the detected roll angle is within a predetermined range.

13. The fluid balancing system of claim 9, wherein the controller generates an alarm for a user such that a user must permit the controller to move the valve to the first position.

14. A method of balancing fluid levels between a first tank and a second tank, the first tank and the second tank supported on a longwall mining machine, the method comprising:

providing a valve movable between a first position and a second position such that the valve permits fluid communication between the first tank and the second tank when the valve is in the first position, and the valve prevents fluid communication between the first tank and the second tank when the valve is in the second position;

generating a first signal indicative of an amount of fluid contained in the first tank;

generating a second signal indicative of an amount of fluid contained in the second tank;

comparing the first signal and the second signal to calculate a difference between the amount of fluid in the first tank and the amount of fluid in the second tank;

comparing the calculated difference against a predetermined threshold; and when the calculated difference exceeds the predetermined threshold, moving the valve to the first position to permit fluid communication between the first tank and the second tank.

15. The method of claim 14, wherein generating a first signal indicative of an amount of fluid includes sensing a level of the fluid contained in the first tank, and wherein generating a second signal indicative of an amount of fluid includes sensing a level of the fluid contained in the second tank.

16. The method of claim 14, further comprising generating a third signal indicative of a frame angle of a frame of the longwall mining machine with respect to a horizontal plane.

17. The method of claim 16, further comprising, prior to moving the valve to the first position, comparing the third signal against a predetermined range of frame angles, and wherein moving the valve to a first position is allowed if the sensed frame angle is within the predetermined range.

18. The method of claim 14, further comprising, prior to moving the valve to the first position, requesting permission from a user for the controller to move the valve to the first position.

* * * * *